US005467530A

United States Patent [19]

Althaus

[11] Patent Number: 5,467,530

[45] Date of Patent: Nov. 21, 1995

[54] WET RAZOR

[75] Inventor: Wolfgang Althaus, Wuppertal, Germany

[73] Assignee: Warner-Lambert Company, Morris Plains, N.J.

[21] Appl. No.: 179,141

[22] Filed: Jan. 7, 1994

[30] Foreign Application Priority Data

Jan. 8, 1993 [DE] Germany ..... 9300148 U

[51] Int. Cl.[6] ..... B26B 21/52

[52] U.S. Cl. ..... 30/85; 30/50; 30/53

[58] Field of Search ..... 30/29.5, 30, 32, 30/40, 47–50, 85, 90, 346.5, 53

[56] References Cited

U.S. PATENT DOCUMENTS

| | | | |
|---|---|---|---|
| D. 159,994 | 9/1950 | Lee | 30/304 |
| 941,231 | 11/1909 | Cupelli | 30/53 |
| 1,354,658 | 10/1920 | Kane . | |
| 1,790,546 | 1/1931 | Kittle | 30/29.5 |
| 1,831,579 | 11/1931 | Sneed . | |
| 3,557,448 | 1/1971 | Shead . | |
| 3,805,381 | 4/1974 | Broussard | 30/30 |
| 4,037,322 | 7/1977 | Bresler . | |
| 4,454,653 | 6/1984 | Chen . | |
| 4,665,615 | 5/1987 | Martinez | 30/53 |
| 5,090,124 | 2/1992 | Althaus . | |
| 5,093,991 | 3/1992 | Hendrickson . | |

FOREIGN PATENT DOCUMENTS

| | | |
|---|---|---|
| 0306710 | 3/1989 | European Pat. Off. . |
| 2550986 | 3/1985 | France . |
| 2680998 | 3/1993 | France . |
| 267677 | 10/1912 | Germany . |
| 101745 | of 1916 | United Kingdom . |
| 267247 | 3/1927 | United Kingdom . |

*Primary Examiner*—Douglas D. Watts

*Attorney, Agent, or Firm*—Robert W. Becker & Associates

[57] ABSTRACT

A wet or safety razor having an elongated handle and a razor blade unit that is adapted to be mounted on the handle by a holder. When the razor blade unit is mounted on the handle, the cutting edges of the razor blades extend essentially parallel to the longitudinal direction of the handle.

8 Claims, 3 Drawing Sheets

WET RAZOR

BACKGROUND OF THE INVENTION

The present invention relates to a wet or safety razor that has an elongated handle and a razor blade unit that is to be mounted on the handle via holding means.

Wet razors of the aforementioned type are known in general. A razor blade unit is customarily mounted on one end of an essentially elongated handle via a fastening means. As is known, such razor blade units comprise a plastic body in which is embedded a single or double razor blade. If a double razor blade is used, the cutting edges of the two razor blades are offset from one another. In EP 0 307 710, similar razor blade units are disclosed where the plastic body together with the razor blades have a wire wrapped around them to form a plurality of adjacent, helical windings, with the wire being guided at least partially in grooves that are formed in the plastic body. With such recent razor blade units, undesired injury to the skin is avoided and better shaving results are achieved.

A number of fastening means are known for mounting the razor blade units to the handle. Customarily, the razor blade units, which themselves have an elongated body, are placed upon an end edge of a handle in such a way that the longitudinal axis of the handle and the longitudinal axis of the razor blade unit extend perpendicular to one another.

However, with the heretofore known wet razors as described above, the handle, which extends essentially perpendicular to the cutting edges of the razor blades, ordinarily gets in the way during a shaving process. For this reason, the heretofore known wet razor is then held too flat, which leads to poor shaving results and hence undesired nicking or cutting of the skin.

It is therefore an object of the present invention to provide a wet razor that is better suited for shaving in particular areas of the body. It is a further object of the present invention to provide a razor blade unit that is particularly suitable for the inventive razor.

BRIEF DESCRIPTION OF THE DRAWINGS

These and other objects and advantages of the present invention will appear more clearly from the following specification in conjunction with the accompanying schematic drawings, in which.

SUMMARY OF THE INVENTION

The wet razor of the present invention is characterized primarily in that the razor blade unit is mounted on the handle in such a way that the cutting edges of the razor blades extend essentially parallel to the longitudinal direction of a handle.

It is should be understood that "essentially parallel" also includes angles that deviate from the longitudinal direction of the handle.

Thus, pursuant to the present invention, the cutting edges of the razor blades are no longer disposed perpendicular to the surface of the handle, but rather are disposed, for example, on the side of the handle and parallel to the longitudinal direction thereof. Even where the holder has an offset configuration, the cutting edges extend essentially parallel to the longitudinal direction of the holder. Thus, the inventive wet razor can be easily guided along any part of the body and at any desired angle to the body parts that are to be shaved.

If conventional razor blade units are used, the person using the razor is limited to operating the razor in only one direction or with only one hand. Since conventional razor blade units have the cutting edges of the razor blades on one side, which cutting edges are also oriented in only one direction, the user has corresponding difficulties in shaving parts of the body that are difficult to reach.

For this reason, to improve the inventive wet razor, it is proposed that razor blade units be used that on one side have a holding means to mount the unit on the handle, and on the two long sides that adjoin this side be provided with cutting edges. Thus, two opposite sides of the razor blade unit should be respectively provided with dual blades. Particularly advantageous is the use of a razor blade unit having a roof profile or shape, whereby the inside, i.e. the underside, of the unit is provided with the means for pushing the razor blade unit in or on a corresponding mounting means of the handle, and on the two long or longitudinal sides of the razor blade unit the razor blades extend parallel to the longitudinal axis.

Particularly good results are achieved when the novel razor blade unit is combined with the inventive wet razor, whereby the razor blade unit is pressed onto a guide means provided in a recessed portion of an ergonomically shaped handle.

Thus, a user has available a wet razor with which a shave can be carried out essentially with either hand and on any part of the body in any direction.

Further specific features of the present invention will be described in detail subsequently.

DESCRIPTION OF PREFERRED EMBODIMENTS

Figure 1:
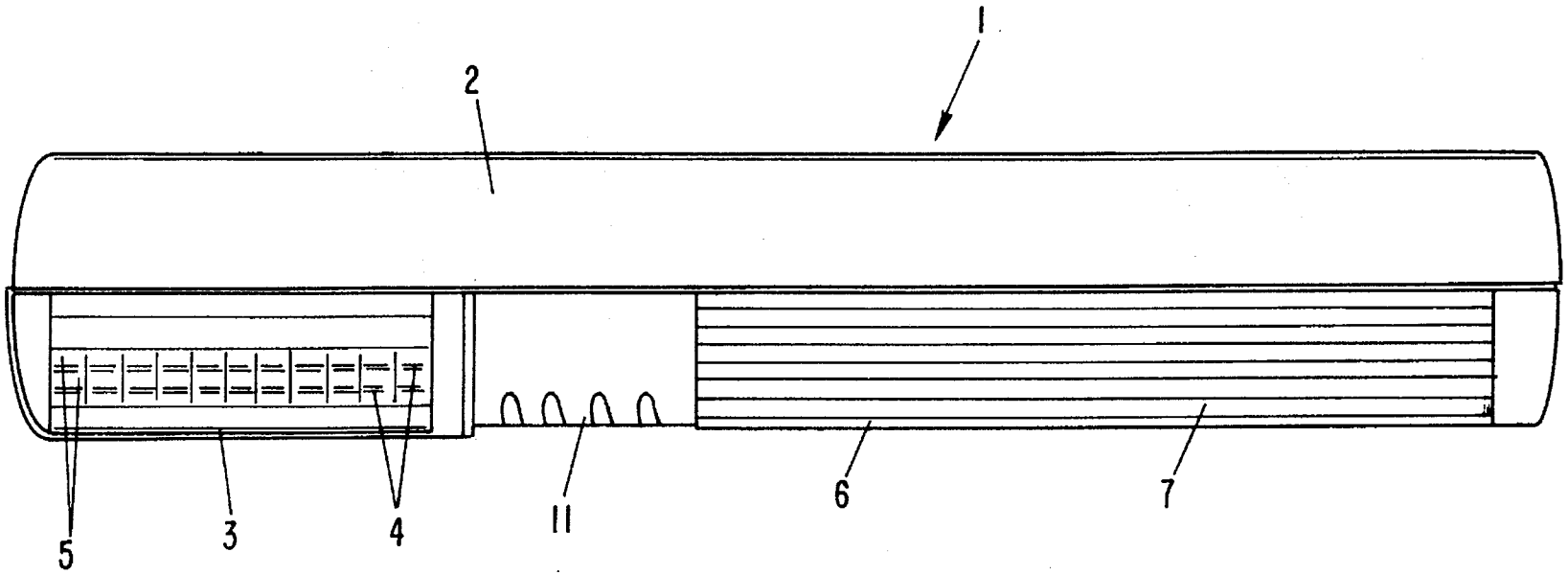
FIG. 1 is a side view of one exemplary embodiment of the inventive wet razor with a razor blade unit placed thereon.

Referring now to the drawings in detail, the wet or safety razor 1 illustrated in FIG. 1 comprises an elongated handle 2 and a razor blade unit 3. The razor blade unit is secured to the handle 2 in such a way that the cutting edges 4 of the razor blades 5 extend parallel to the longitudinal direction of the handle 2.

The handle 2 has an essentially elliptical, ergonomically shaped grip portion 6, the front side of which is provided with an easy to grasp surface structure 7.

Figure 2:
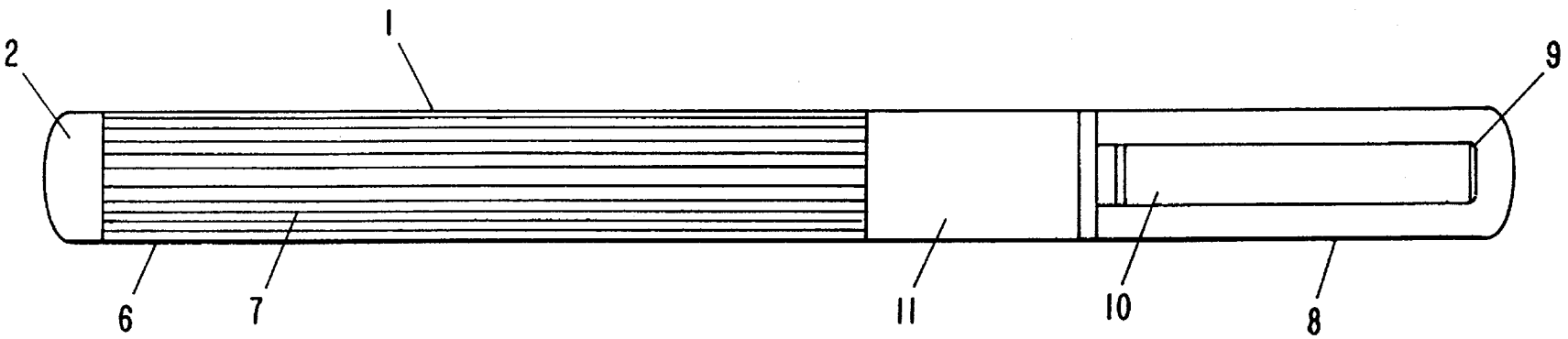
FIG. 2 is a view from above of the inventive wet razor without a razor blade unit placed thereon.
Figure 3:
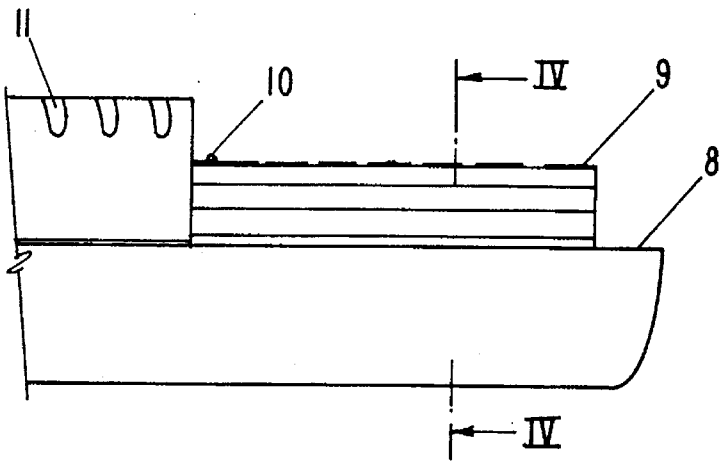
FIG. 3 is a partial side view of the front portion of the inventive wet razor of FIG. 2.

As can be seen in particular in FIGS. 2 and 3, the front portion of the handle 2 is provided with a recessed portion 8 in which is disposed a guide bar means 9 for receiving a razor blade unit 3. The guide bar means 9 has, for example, the cross-sectional configuration that is illustrated in FIG. 4.

It is to be understood, however, that other fastening and securing means for the razor blade unit would also be possible. For example, all types of tongue and groove combinations, snap-type closures, and the like are conceivable.

Figure 4:
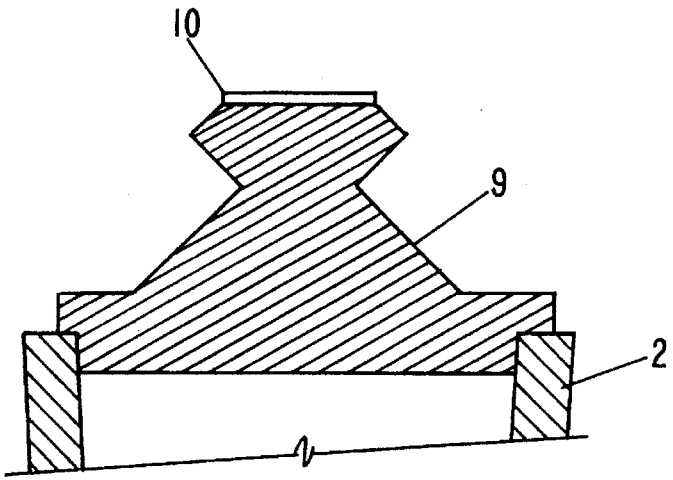
FIG. 4 is a partial cross-sectional view taken along the line IV—IV in FIG. 3.

As shown in FIGS. 2 to 4, disposed on the guide bar means 9 for the securement of the razor blade unit 3 is an engagement projection 10 on which the razor blade unit is slid and then held so that it can then be withdrawn from the guide bar means 9 only by an appropriate pushing or pulling operation.

Disposed between the grip portion 6 and the recessed portion 8 of the handle 2 is an ejection knob 11 that when it is shifted toward the front, for example with the thumb of a hand that is grasping the handle, pushes a placed-on razor blade unit 3 off of the guide bar means 9 and out of the recessed portion 8 via the engagement projection 10.

Figure 5:
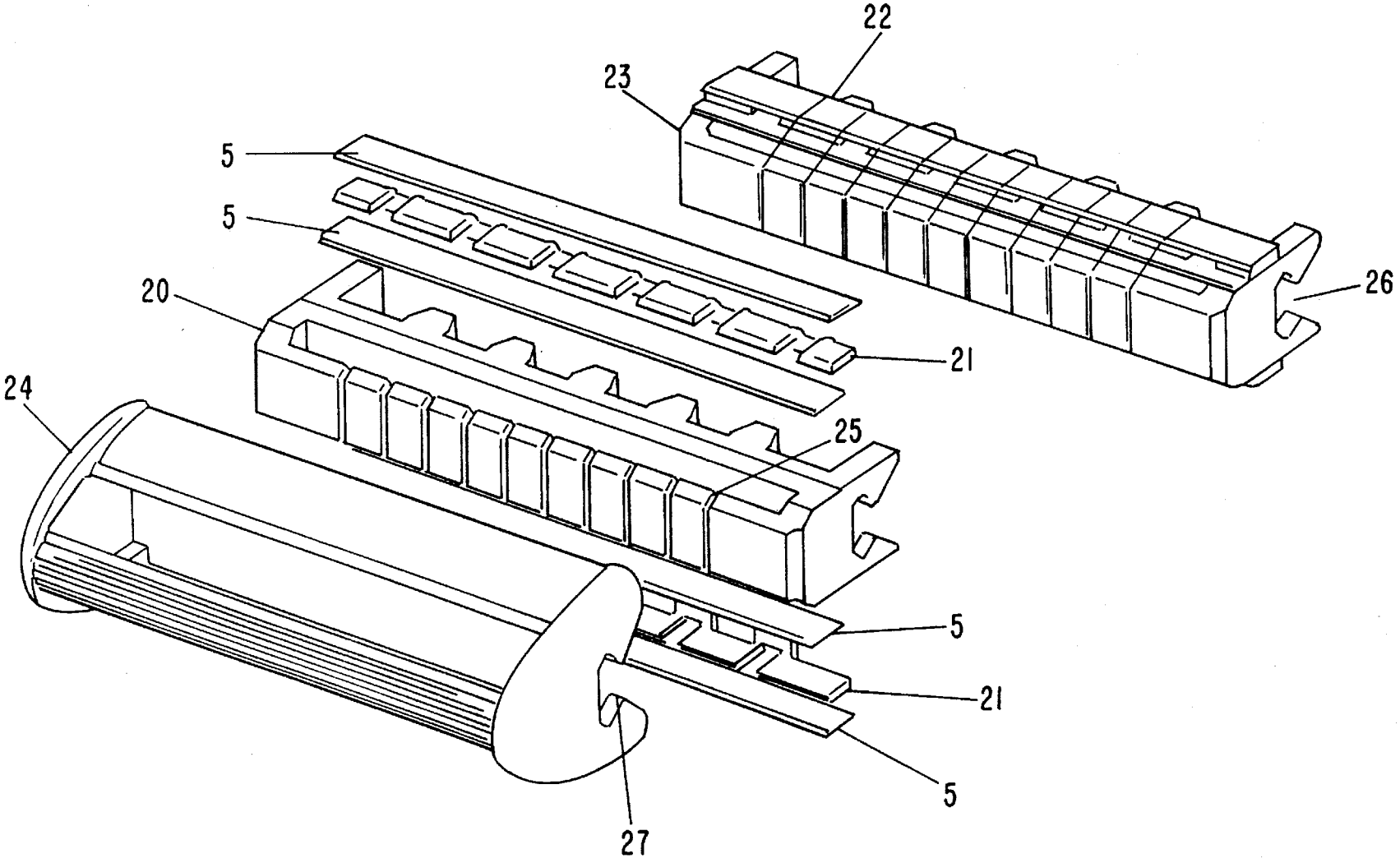
FIG. 5 is an exploded view of one exemplary embodiment of the inventive razor blade unit.

One exemplary embodiment for a novel razor blade unit for the inventive wet razor is shown in FIG. 5. This razor blade unit comprises a plastic body 20 that has an elongated configuration and an essentially rectangular cross-sectional area. Two razor blades 5, between which is disposed a spacer 21, are respectively disposed on each side of the plastic body 20. The plastic body 20 together with the razor blades 5 and the spacers 21 then have a wire 22 wound around them, with this wire forming helical windings that are spaced from one another. The blade unit 23 that is formed in this manner is disposed in a roof-shaped cap 24, thereby forming a complete blade unit.

To keep the wire windings from sliding off to the side, the front edge of the plastic body 20 can be provided with notches 25.

The underside 26 of the plastic body 20, as well as the undersides of the side portions 27 of the cap 24, can be embodied in such a way that the blade unit can be placed upon an appropriate guide means, such as the guide bar means 9 shown in FIGS. 2 to 4.

A blade unit fashioned in this manner can be made available in a so-called dispenser, the outward shape of which essentially corresponds to the oversized roof shape of the blade unit, and into which the blade unit can be pressed from the side. This makes it possible to remove the blade unit from the dispenser basically with one hand by shoving the blade unit onto the guide bar means.

The present invention is, of course, in no way restricted to the specific disclosure of the specification and drawings, but also encompasses any modifications within the scope of the appended claims.

What I claim is:

1. A wet razor, comprising:

an elongated handle extending in a longitudinal direction and having a first end that is provided with a recessed portion which extends in said longitudinal direction of said handle, said recessed portion forming a cutout in said handle such that said recessed portion defines a planar surface, said cutout being open at said first end of said handle such that said planar surface extends all the way to said first end;

guide and holding bar means that projects from said planar surface of said recessed portion and extends in said longitudinal direction of said handle;

a razor blade unit that is provided with razor blades and with means for holdingly engaging said guide and holding bar means such that when said razor blade unit is mounted on said handle via cooperation of said guide and holding bar means and said means of said razor blade unit for engaging said guide and holding bar means, cutting edges of said razor blades of said razor blade unit extend essentially parallel to said longitudinal direction of said handle.

2. A wet razor according to claim 1, wherein adjacent to said guide means, said handle is provided with an ejection knob for removing said razor blade unit from said guide means.

3. A wet razor according to claim 2, which includes spring means for holding said ejection knob in a non-displaced position of rest.

4. A wet razor according to claim 1, wherein a protective cap is provided for said razor blade unit.

5. A wet razor according to claim 1, wherein said razor blade unit has a first side that is provided with said means for engaging said guide and holding bar means, and has two further sides that are respectively adjacent said first side and extend in a longitudinal direction of said razor blade unit, each of said two further sides being provided with razor blades having cutting edges that extend parallel to said longitudinal direction of said razor blade unit.

6. A wet razor according to claim 5, wherein said razor blade unit includes an elongated plastic body with two opposite sides on which said razor blades are disposed, whereby wound around said plastic body and said razor blades are adjacent helical windings of a wire.

7. A wet razor according to claim 1, wherein said guide and holding bar means and said means of said razor blade unit for engaging said guide and holding bar means are complementarily shaped, with one being in the form of an engagement projection and the other being in the form of a receiving groove.

8. A wet razor according to claim 7, wherein said engagement projection is in the form of a tongue formed on said guide and holding bar means remote from said planar surface of said recessed portion, and said means of said razor blade unit for engaging said guide and holding bar means is a groove for slidingly receiving said tongue of said guide and holding bar means.

* * * * *